US006984124B2

(12) United States Patent
Mosiewicz et al.

(10) Patent No.: US 6,984,124 B2
(45) Date of Patent: Jan. 10, 2006

(54) HIGH TEMPERATURE RISE MAKEUP AIR UNIT

(75) Inventors: Pawel Mosiewicz, Chicago, IL (US); Ceji Li, Bolingbrook, IL (US)

(73) Assignee: Midco International, Inc., Chicago, IL (US)

( * ) Notice: Subject to any disclaimer, the term of this patent is extended or adjusted under 35 U.S.C. 154(b) by 0 days.

(21) Appl. No.: 10/666,312

(22) Filed: Sep. 18, 2003

(65) Prior Publication Data

US 2005/0064356 A1 Mar. 24, 2005

(51) Int. Cl.
*F23D 14/46* (2006.01)

(52) U.S. Cl. ..... 431/350; 431/351; 431/352; 432/222

(58) Field of Classification Search ..... 431/10, 431/350, 351, 352; 432/222
See application file for complete search history.

(56) References Cited

U.S. PATENT DOCUMENTS

| | | | | |
|---|---|---|---|---|
| 3,881,863 | A * | 5/1975 | Creuz | 432/222 |
| 6,394,795 | B2 * | 5/2002 | Fayerman et al. | 432/222 |
| 6,526,964 | B1 | 3/2003 | Potter et al. | |
| 6,558,533 | B2 | 5/2003 | Schmidt et al. | |
| 6,564,794 | B1 | 5/2003 | Zia et al. | |
| 6,598,599 | B2 | 7/2003 | Takeuchi | |
| 6,599,119 | B1 | 7/2003 | Wood et al. | |

* cited by examiner

*Primary Examiner*—Jiping Lu
(74) *Attorney, Agent, or Firm*—Marshall, Gerstein & Borun LLP

(57) ABSTRACT

A direct-air, gas-fired air makeup heating unit is disclosed which provides reduced nitrogen dioxide emissions with a higher temperature rise. The unit includes a combustion chamber with a protective chamber downstream of the combustion chamber. At high firing intensity, the flame exits the combustion chamber and enters the protective chamber. The resulting flame is therefore protected from excess air moving around the combustion chamber, thereby lowering nitrogen dioxide emissions even at such high firing intensities.

13 Claims, 3 Drawing Sheets

HIGH TEMPERATURE RISE MAKEUP AIR UNIT

FIELD OF THE DISCLOSURE

The disclosure generally relates to a heating apparatus and, more particularly, relates to gas-fired burners for high temperature rise, direct-heating applications.

BACKGROUND OF THE DISCLOSURE

In many situations, air within a building must be continually replaced for health and comfort reasons. Conditions such as these are frequently found in paint spray shops, foundries, chemical plants, welding shops, large restaurants, bowling alleys, warehouses, etc. However, taking in a large amount of ambient air, heating the air, and introducing it to the building can over burden existing heating systems. In such situations, a "makeup" air heater is often used to temper the incoming air, raising its temperature to the room temperature, and thus relieving the building heating plant from the extra load.

Makeup air units typically utilize either direct or indirect fire burners. In a direct fire system, the flame and its by-products are mixed directly with the incoming air stream and are added directly to the heated space. A heating process such as this does not require a heat exchanger and thus is more energy efficient than indirect fire systems. However, as the burner is located and operated directly in the air flow, typically within the existing duct work of the facility, the products of combustion are added directly to the heated space along with the heated air. Control of emissions is therefore of most concern. The oxygen needed for combustion in such systems is typically provided or generated by a fan or blower located downstream of the burner.

A direct fire burner is designed essentially from two main components: a gas manifold and air baffles. The gas manifold distributes gas evenly along the entire length of the burner. Air baffles are designed to create a combustion chamber and distribute a controlled amount of air into such a chamber. The baffles further serve to protect the flame from an excess supply of air, thus preventing the flame from being quenched.

In such units, the burner is typically positioned within an air duct proximate a profile opening. More specifically, a partition extends laterally across the air duct with the profile opening being provided centrally within the partition. The gas manifold and baffles of the burner are positioned so as to exhaust the flame and its combustion gases through the profile opening. The profile opening is designed to create a known pressure drop or velocity of air across the burner assembly. This velocity defines the operating range of the burner. If the pressure drop is too high or too low, the burner will not function properly. The proper size of the profile opening in such units is dictated by the total airflow through the unit and the size of the burner.

However, some systems are designed to deliver a variable air flow. In such units, where the total airflow delivered to the heated space changes, dampers are typically mounted adjacent the profile opening to adjust the effective size of the profile opening and thus the pressure drop across the burner. For example, at maximum airflow the dampers open and increase the overall size of the profile opening. Similarly, at minimum airflow the dampers close to decrease the overall size of the profile opening. Depending on the desired airflow, the dampers can be positioned anywhere in between fully open and fully closed.

While effective, such an approach is designed only to control airflow around the burner and to keep the burner operating per manufacturing instructions. No attempt is made to control the airflow downstream of the burner, nor is any attempt made to control emission output levels. Rather, the objective of such units is to provide a specific pressure drop across the burner to provide the combustion chamber with sufficient amounts of air at low to intermediate firing intensities to sustain proper combustion. At high firing intensities, such units rely on excessive air directed around the burner downstream of the profile opening, but by providing such an excess amount of unconditioned air downstream of the burner, emission output levels increase.

The most notable emission is nitrogen dioxide ($NO_2$). Its production is the single most limiting factor in obtaining a high temperature rise in a direct-fire makeup unit in that firing intensity cannot simply be increased to a desired temperature rise if doing so results in undesirably high emission outputs. The current standards for acceptable nitrogen dioxide emission levels are regulated by statue. ANSI standards Z83.4 (non re-circulating direct gas fired industrial air heaters), and Z83.18 (re-circulating direct gas fired industrial air heaters) limit nitrogen dioxide emissions levels to 0.5 ppm (parts per million). The level of nitrogen dioxide emissions increases with temperature rise. The maximum temperature rise a direct fire heater can obtain is that temperature reached when nitrogen dioxide emissions levels, as they are currently regulated, are reached.

With a 0.5 ppm nitrogen dioxide emissions limit, a standard makeup air heater can typically achieve a maximum temperature rise of 100–120° F. (i.e., elevating the temperature of incoming air by 100 to 120° F.). To achieve higher temperature rise, for example, up to 140° F., manufacturers of makeup air units have reduced the overall air (measured in cubic feet per minute (cfm)) and gas (measured in British Thermal Units (BTU)) inputs. Since the emission of nitrogen dioxide is related to flame quenching and mixing of flames and their by-products with excess, cold, surrounding air, if the flame interaction with the air is limited, lower emission levels of nitrogen dioxide can be achieved. However, while such current systems can reach higher temperature rise due to slower air flow through the burner, and more uniform flow into the blower, the resulting burner is larger and more expensive than is desired, and takes longer to heat a given space due to the lower overall airflow.

It would therefore be desirable to provide such a direct air gas burner of a relatively compact inexpensive design, but which can provide greater air temperature rise for a given size, while still meeting current $NO_2$ emissions regulations.

SUMMARY OF THE DISCLOSURE

In accordance with one aspect of the disclosure, a burner assembly is disclosed which may comprise a duct, a burner, and a protective chamber disposed within the duct and including a profile opening adapted to receive the flame.

In accordance with another aspect of the disclosure, a burner assembly is disclosed which may comprise an air duct, an interior wall extending across an interior of the air duct, a burner, and first and second side walls extending from the interior wall away from the burner. The interior wall may include at least three openings with a first opening being provided in an interior of the wall, and the second and third openings flanking the wall. The burner may include a combustion chamber and a flame outlet, with the flame outlet being positioned proximate the interior wall first opening.

In accordance with another aspect of the disclosure, a burner assembly is disclosed which may comprise an air duct, a gas supply, an ignition means, a combustion chamber, a protective chamber, and first and second plenums. The air duct may be adapted to direct heated air and by-products of combustion to a space to be heated while the gas supply is disposed within the air duct. The ignition means may be provided proximate the gas supply with the primary combustion chamber being downstream of the gas supply. The secondary combustion chamber in turn may be downstream of the primary combustion chamber. The first and second air plenums may flank the protective chamber.

These and other aspects and features of the disclosure will become more apparent upon reading the following detailed description when taken in conjunction with the accompanying drawings.

Figure 1:
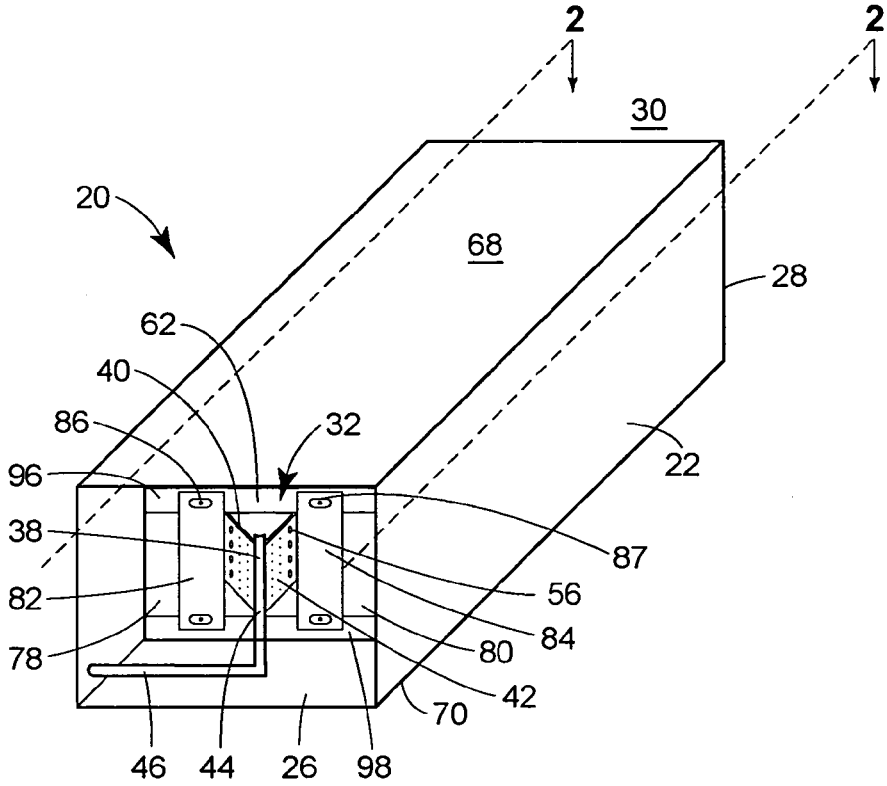
FIG. 1 is a perspective view of a burner assembly constructed in accordance with the teachings of the disclosure.

While the disclosure is susceptible to various modifications and alternative constructions, certain illustrative embodiments thereof have been shown in the drawings and will be described below in detail. It should be understood, however, that there is no intention to limit the present disclosure to the specific forms disclosed, but on contrary, the intention is to cover all modifications, alternative constructions, and equivalents falling within the spirit and scope of the disclosure as defined by the appended claims.

DETAILED DESCRIPTION OF THE DISCLOSURE

Figure 2:
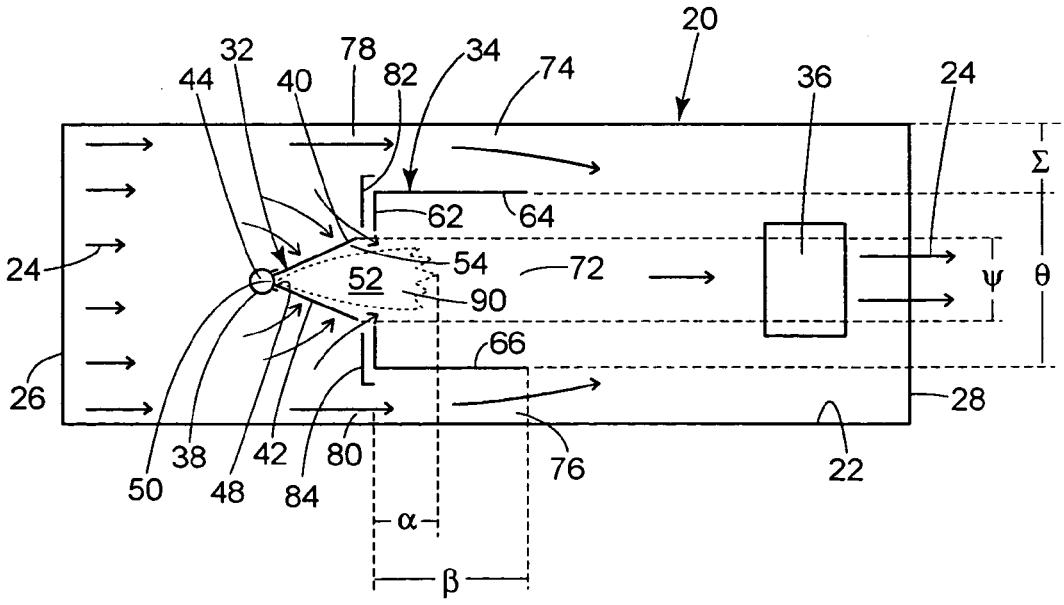
FIG. 2 is a sectional view of the burner assembly of FIG. 1 taken along line 2—2 of FIG. 1.

Referring now to the drawings, and with specific reference to FIG. 1, a makeup air unit constructed in accordance with the teachings of the disclosure is generally referred to by reference numeral 20. As shown therein, the makeup air unit 20 may include a duct 22 of the type used in most HVAC (Heating Ventilation and Air Conditioning) applications and adapted to direct air 24 from an inlet 26 to an outlet 28 (FIG. 2). In traversing the duct 22, the air is heated to a desired temperature and introduced to a space 30 to be heated along with the products of the combustion. In so doing, it will be understood that such a makeup air unit 20 is referred to as a direct fire burner, in that not only is heated air introduced to the space 30, but so are the products of combustion.

The makeup air unit 20 may further include a burner 32 positioned within the inlet 26 of the duct 22, and on an upstream side of a protective chamber 34. As used herein, movement from the inlet 26 to the outlet 28 is referred to as downstream, while a movement or relative placement from the outlet 28 to the inlet 26 is referred to as upstream. Completing the main components of the unit 20, a blower or fan 36 may be provided downstream of the protective chamber 34 to create an air stream through the make-up air unit 20. Any form of blower or fan including motor and impeller units will suffice. It should also be noted that the blower or fan 36 need not be provided downstream of the protective combustion chamber 34, but could be provided adjacent the inlet 26, or in other words upstream of the primary and secondary combustion chambers. The air stream may be a fresh air stream wherein the inlet 26 is connected to source of fresh air (not shown), or may be a re-circulating stream wherein the inlet 26 and outlet 28 are both connected to the space 30 to be heated.

Figure 3:
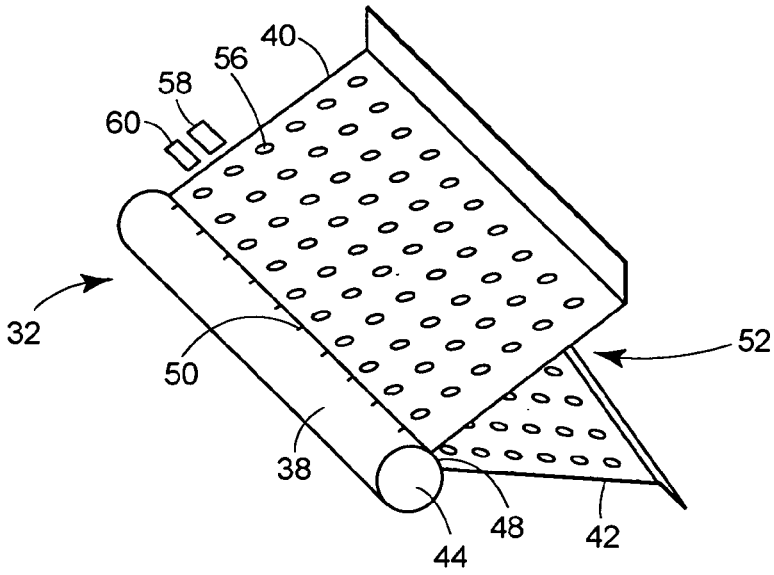
FIG. 3 is a perspective view of a burner forming a part of the burner assembly of FIG. 1.

With specific reference to the burner 32, FIG. 3 best depicts the burner 32 as including a gas manifold 38 having first and second baffles 40, 42 extending therefrom. The gas manifold 38 may include an inlet 44 connected to a gas supply 46. A trough 48 is provided within the gas manifold 38 and includes a plurality of injection apertures 50 through which gas from the inlet 44 is introduced for combustion. The first and second baffles 40 and 42 extend from the gas manifold 38 at angles thereto forming a wedge-shaped combustion chamber 52 having a flame outlet 54. First and second end plates (not shown) may also be provided to more fully confine the combustion chamber 52.

Each of the baffles 40 and 42 includes a plurality of apertures 56 through which combustion air is able to enter the combustion chamber 52. The plurality of apertures 56 are provided in progressively larger sizes along the length of the baffles 40, 42, the importance of which will be discussed in further detail herein. An ignition source 58 and flame sensing rod 60 may also be provided within the combustion chamber 52 as is conventional.

Referring again to FIG. 2, the protective chamber 34 is shown in more detail. The protective chamber 34 may be formed by a face plate 62, from which first and second sides 64, 66 extend in a downstream direction. In cooperation with the top 68 and the bottom 70 of the duct 22, it can therefore be seen that the protective chamber 34 forms a substantially complete enclosure with an open back side 72 opening toward the blower 36. The protective chamber 34 is also fixed in size and location within the duct 22. In so doing, the protective chamber 34 forms first and second air plenums 74, 76 which laterally flank the protective chamber.

Additional structure is provided to adjust the width of the openings 78, 80 to the plenums 74, 76, respectively. As shown best in FIG. 4, panels 82, 84 are mounted upstream of the protective chamber 34 in sliding fashion. Accordingly, the panels 82, 84 can be slid away from the burner 32 thereby adjusting the width of the plenum opening 78, 80 and thus adjusting the pressure drop across the burner 32 and the total volume of air flowing through the unit 20. Any number of mechanical devices can be used to adjust the position of the panels 82, 84 with the depicted embodiment providing slots 86 in each panel 82, 84 through which fasteners 87 extend. Once the desired dimension is achieved the fasteners 87 can be secured in position. As one of ordinary skill in the art will understand, any type of fastener may be employed including, but not limited to, threaded bolts and screws.

In the depicted embodiment, both the face plate 62 and the side 64, 66 are provided in imperforate form so as to preclude air from entering the protective chamber 34 in any manner other than through a profile opening 88 within the face plate 62. More specifically, as will be noted from FIGS. 2 and 4, the burner 32 does not abut the protective chamber 34, but is spaced relative thereto. The profile opening 88 therefore allows for a controlled amount of combustion air to enter the protective chamber 34, but requires the majority of air to go around the protective chamber 34, the importance of which will be discussed in further detail herein.

In operation, it can therefore be seen that the makeup air unit 20 constructed in accordance with the teachings of the present disclosure operates to protect the flame extending from the burner from exposure to excess air, thereby enabling the burner to operate at maximum firing intensity while at the same time meeting current nitrogen dioxide emission requirements. More specifically, referring to FIG. 2 it can be seen that as air enters the makeup air unit 20, part of the air enters the burner 32, part of the air enters the protective chamber 34, and the majority of air is directed around the protective chamber 34, through the first and second air plenums 74 and 76. Only a relatively small portion of the total volume of air is directed into the combustion chamber 52 through the plurality of apertures 56 and the baffles 40, 42 to provide for combustion at low and medium firing intensities. An additional small amount of air enters the protective chamber 34 through the profile opening 88, to provide for combustion at high firing intensities. The majority of air is separated from the flame by the protective chamber 34 and traverses through the plenums 74 and 76.

With more specific reference to the plurality of apertures 56, it will be noted from FIG. 3 that such apertures 56 are designed in size to allow for only defined amounts of air into the combustion chamber 52 as needed for clean combustion. At low firing rates, the flame, identified by reference numeral 90, is located close to the gas manifold 38, and the air apertures 56 near the gas manifold 38 are thus sized to be relatively small and allow only limited amount of air into the combustion chamber 52 to match the low firing intensity. As the firing intensity changes, the flame begins to fill the combustion chamber 52 and moves away from the gas manifold 38. To accommodate for such larger firing intensities, the apertures 56 in the baffles 40, 42 are sized progressively larger as they move away from the gas manifold 38. At maximum firing intensity, the flame 90 fills the entire combustion chamber 52 and in most cases extends beyond the air baffles 40, 42. The apertures 56 at the ends of the baffles 40 and 42 are therefore the largest of all.

In prior art heaters, it was at the above-referenced maximum firing intensity that nitrogen dioxide levels would reach unacceptable limits thereby curtailing the maximum temperature rise obtainable by the unit. This is due to the flame exceeding the air baffles and thus being exposed to large volumes of uncontrolled, unconditioned air. More specifically, when a flame exceeds the air baffles and is exposed to air going around the profile opening, the emission of nitrogen dioxide can not be controlled. With such burner and profile opening arrangements, the flame emission characteristics depend on the air flow around the burner. For turbulent or uneven flows, nitrogen dioxide emissions increase resulting in low temperature rise units. With laminar, fairly even, airflows, the flame is still in contact with excessive air flow and results in higher temperature rise units i.e., up to 120° F. For oversized heaters, the air flow around the burner and through the profile opening possess slow mixing characteristics in a very laminar flow and very little interaction of the air and flame. Such heaters typically achieved higher temperature rises of perhaps up to 140° F. However, while such temperature rises were possible, the nitrogen dioxide emissions are unacceptable.

The present disclosure therefore takes a different approach. To control the nitrogen dioxide emissions and to limit its influence on the temperature rise, a method of redirecting a majority of the incoming air away from the burner has been implemented. This approach controls the amount of air downstream of the burner and shields the flame from excess air going around the burner. The protective chamber 34 is designed in such a way as to protect or shield the flame from excess air, as well as to allow combustion gases to expand and not be quenched by the walls of the chamber.

With reference now to FIG. 2, the manner in which the above-reference structure controls the air flow will be described in further detail. It will be noted that the flame 90 extends from the combustion chamber 52 by a distance $\alpha$. It will also be noted that the protective chamber 34, more specifically, the sides 64, 66 extend away from the face plate 62 by a distance $\beta$, which is greater than the distance $\alpha$. In so doing, the flame 90 is entirely contained within the protective chamber 34 and protected from exposure to excess air, thus emissions of nitrogen dioxide are reduced. More specifically, to control nitrogen dioxide emissions and to limit its influence on the temperature rise, the protective chamber 34 controls the amount of air downstream of the burner and shields the flame 90 from excess air going around the burner 32. By shielding the flame 90, the emissions of nitrogen dioxide are reduced to acceptable levels, thereby allowing the burner assembly 20 to fire at maximum intensity to attain much higher temperature rises than previously attainable.

Figure 5:
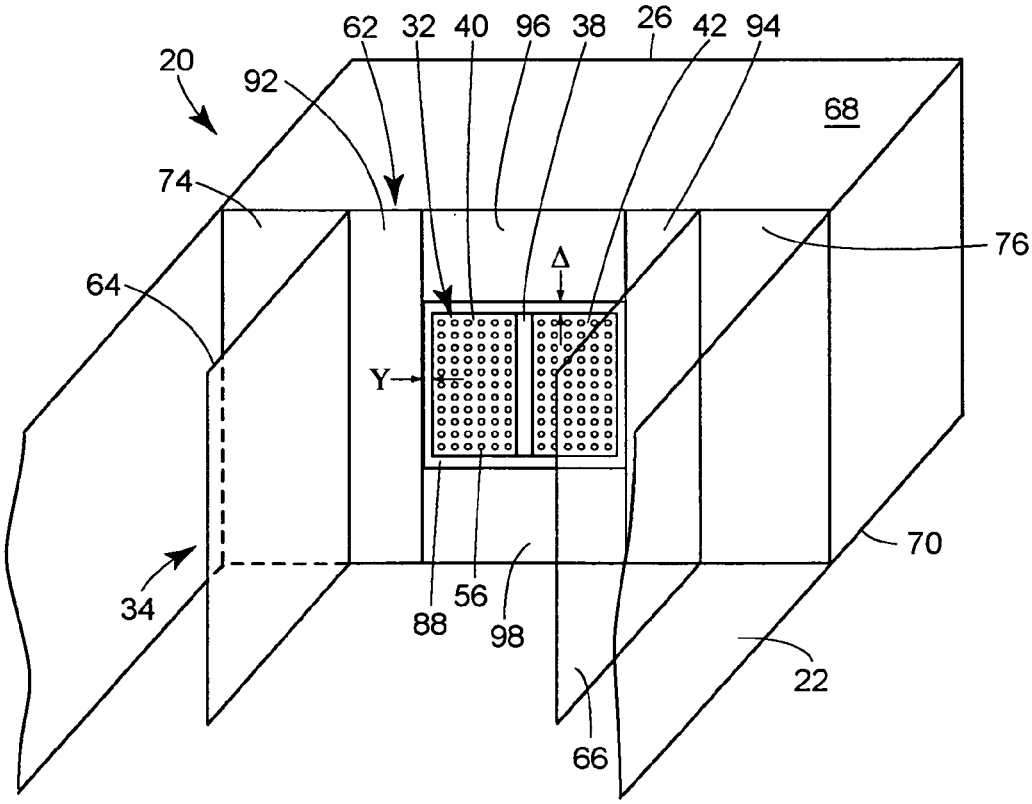
FIG. 5 is a cut-away view of the burner assembly of FIG. 1 taken from an end opposite of that depicted in FIG. 4.
Figure 4:
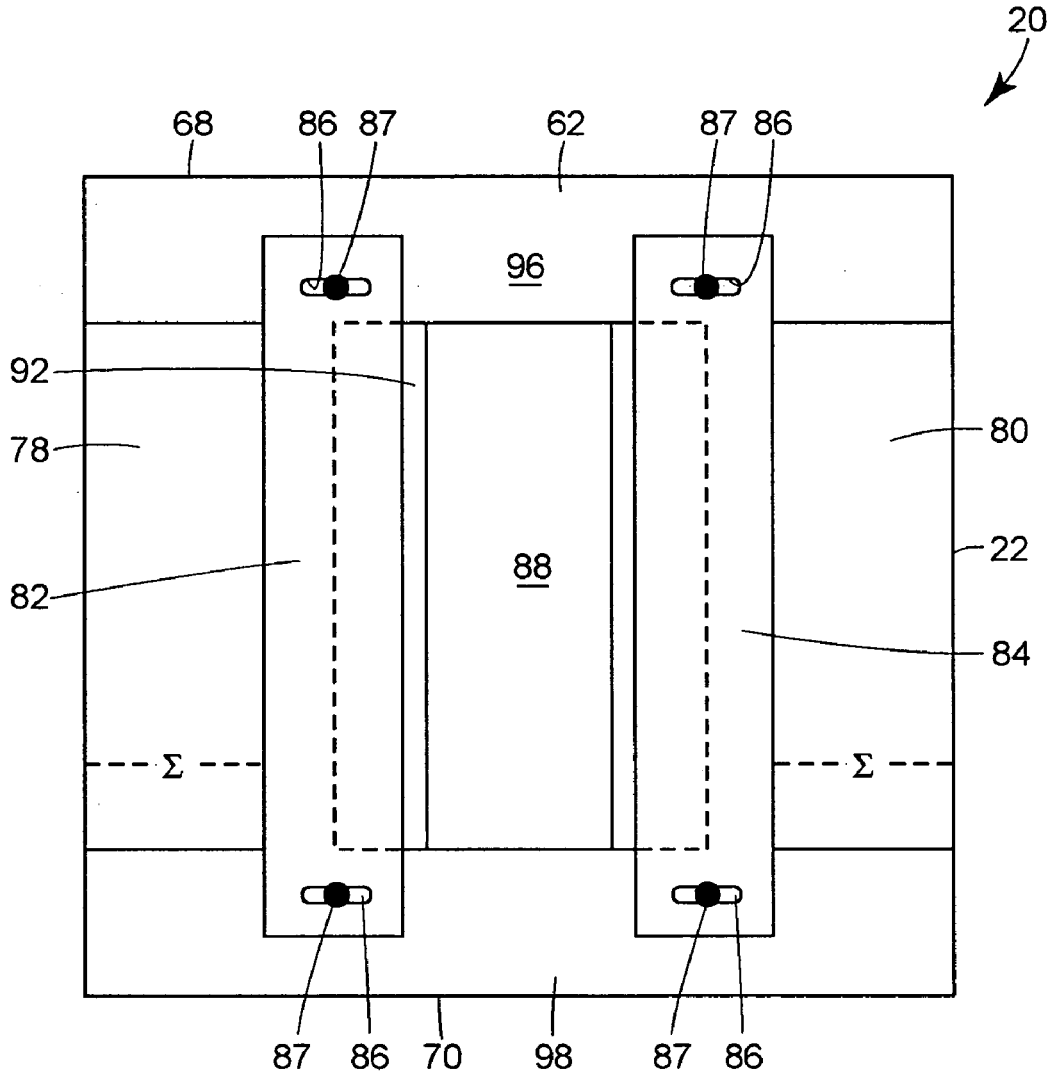
FIG. 4 is an end view of the burner assembly of FIG. 1, but without the burner being depicted.

The location of the burner 32 relative to the profile opening 88 is also of importance and is depicted best with reference to FIGS. 4 and 5. As noted therein, the burner 32 is spaced from sides 92, 94 of the face plate 62 by distance $\gamma$ in a lateral direction, and from the top and bottom portions 96, 98 of the face plate 62 by a distance $\Delta$. The distance $\Delta$ should be set to a minimum level and in most applications should not exceed a dimension of one inch, whereas the distance $\gamma$ should also be set to a minimum level, but in most applications should not exceed a dimension of four inches. Of course, other dimensions are certainly possible and encompassed within the teachings of the disclosure. For example, the size of the duct and air space to be heated, as well as the speed with which it is to heated, and degree to which it is to be heated, all may affect the optimal spacings for such dimensions.

The width $\Sigma$ of the plenums 74 and 76 are also important and should not exceed ten inches in lateral dimension, although it is to be understood that in alternative embodiments, alternative dimensions are certainly possible as well. The openings to the plenums 74 and 76 can also be adjusted by movement of the panels 76, 78 as indicated above. In so doing, the pressure drop across the burner 32, and total air flow through the unit 20 can be adjusted to desired levels. The width $\theta$ of the protective chamber 34 relative to the width $\phi$ of the burner 32 is also important. The protective chamber 34 should be sufficiently wider than the burner 32 to enable the combustion gases to expand and prevent the flame 90 from quenching on the sides 64, 66 of the chamber 34. Accordingly, the face plate sides 92, 94 should be sized to maximum and in the depicted embodiment should not be less than two inches.

As can be seen from above, to control nitrogen dioxide emission levels and to limit its influence on temperature rise, a method of redirecting a majority of incoming combustion air away from the burner is implemented. This approach controls the amount of air downstream of the burner and shields the flame from excess air going around the burner. In accordance with the teachings of the disclosure, the protective chamber serves as an extension of the burner air baffles which, as indicated above, are equipped with air openings that are sized for corresponding fire intensity. At low fires, openings provided within the baffles are sufficient for proper combustion. At maximum fire intensity, the flame extends past the air baffles and into the protective chamber. In so doing, the flame is sheltered from excess air. However, the amount of air that penetrates the air baffles and enters the combustion chamber is insufficient for complete combustion when the burner is operated at maximum firing intensity. Accordingly, the profile opening around the burner serves as the final air entry point for combustion to complete. This amount of air is controlled to provide for proper combustion. More specifically, if too much air is added into the protective chamber, the flame would be quenched resulting in high nitrogen dioxide emissions. On the other hand, if too little air is added, the flame length would increase beyond the protective chamber resulting in an unpredictable flame which again would lead to high nitrogen dioxide emissions.

From the foregoing, one of ordinary skill in the art will readily appreciate that the present disclosure sets forth an apparatus and method for a high-temperature, direct-fired, heater assembly which lowers the emissions of nitrogen dioxide while allowing the heater to achieve higher than heretofore possible temperature rise.

What is claimed is:

1. A burner assembly, comprising:

a duct;

a burner disposed within the duct, the burner including a gas manifold and first and second baffles extending therefrom and defining a combustion chamber; and a protective chamber disposed within the duct and including a profile opening adapted to receive a flame from the burner, the protective chamber being downstream relative to, and separated and spaced away from, the burner, the protective chamber including a face plate and side panels that are disposed perpendicular to the face place, the face place being perpendicular to a longitudinal axis of the duct.

2. The burner assembly of claim 1, wherein the first and second baffles each include a plurality of apertures.

3. The burner assembly of claim 1, wherein protective chamber includes imperforate walls.

4. The burner assembly of claim 1, wherein the combustion chamber is wedged shaped.

5. The burner assembly of claim 1, further including first and second panels slidably mounted to the face plate.

6. The burner assembly of claim 1, wherein the burner is adapted to produce a flame extending past the baffles by a length $\alpha$, and wherein the protective chamber extends past the first and second baffles by a distance greater than $\alpha$.

7. The burner assembly of claim 1, wherein the face plate includes a top, a bottom, and first and second sides defining the profile opening, the burner being disposed on an upstream side of the profile opening, the protective chamber sides being disposed on a downstream side of the profile opening.

8. The burner assembly of claim 7, wherein the face plate top and bottom are spaced from the burner by a distance $\Delta$, and the face plate first and second sides are spaced from the burner by a distance $\gamma$, the distances $\Delta$ and $\gamma$ being fixed.

9. The burner assembly of claim 1, wherein the protective chamber and duct define first and second plenums flanking the protective chamber.

10. A burner assembly, comprising:

an air duct adapted to direct heated air and products of combustion to a space to be heated;

a gas supply disposed within the air duct;

an ignition means proximate the gas supply;

a combustion chamber downstream of the gas supply;

a protective chamber downstream of the combustion chamber, the protective chamber including a profile opening, the protective chamber being separate and spaced away from the combustion chamber, the protective chamber is formed by a face plate, first and second sides depending from the face plate, and a top and bottom of the duct; and first and second air plenums flanking the protective chamber.

11. The burner assembly of claim 10, wherein the combustion chamber is formed by a gas manifold and first and second baffles extending from the gas manifold, the first and second baffles including a plurality of apertures, combustion air for the combustion chamber entering through the plurality of baffle apertures.

12. The burner assembly of claim 11, further including gaps between the profile opening and the baffles, the dimensions of the gaps being predetermined.

13. The burner assembly of claim 10, further including first and second slidable panels mounted to the face plate.

* * * * *